US005644879A

United States Patent [19]

Shreiner et al.

[11] Patent Number: 5,644,879

[45] Date of Patent: Jul. 8, 1997

[54] SEISMIC EXPANSION JOINT COVER ASSEMBLY

[75] Inventors: Thomas A. Shreiner, Picture Rocks; Roger W. Barr, Williamsport; Howard Williams, Muncy, all of Pa.

[73] Assignee: Construction Specialties, Inc., Cranford, N.J.

[21] Appl. No.: 383,572

[22] Filed: Feb. 3, 1995

[51] Int. Cl.[6] ..... E04B 1/684

[52] U.S. Cl. ..... 52/393; 52/573.1; 52/396.02; 52/396.03

[58] Field of Search ..... 52/573.1, 393, 52/396.02, 396.03

[56] References Cited

U.S. PATENT DOCUMENTS

| | | | |
|---|---|---|---|
| 4,517,779 | 5/1985 | Dunsworth . | |
| 4,963,056 | 10/1990 | Cihal | 52/396.03 X |
| 5,078,529 | 1/1992 | Moulton . | |
| 5,365,713 | 11/1994 | Nicholas et al. | 52/573.1 |

FOREIGN PATENT DOCUMENTS

| | | | |
|---|---|---|---|
| 2738429 | 3/1979 | Germany | 52/396.03 |

OTHER PUBLICATIONS

Architectural Plans dated Jun. 27, 1994, San Bernadino County (CA) Medical Center Replacement Project; Perkins & Will.

*Primary Examiner*—Wynn E. Wood

*Attorney, Agent, or Firm*—Brumbaugh, Graves, Donohue & Raymond

[57] ABSTRACT

A seismic expansion joint cover includes a floor bridge panel having mutually perpendicular elongated U-shaped bearing receiver guideways adjacent its opposite ends slidably supported by linear bearings affixed to the floor portions on opposite sides of the gap. The receiver guideways are open vertically to allow the floor bridge cover to displace vertically. A cover plate frame defines the boundaries of a floor recess that receives portions of the floor bridge panel in all relative positions of the floor portions as the width of the gap changes. The portion of the floor bridge panel that overlies the gap is covered by a first floor cover plate, and the recess and the remaining portion of the floor bridge plate are covered by a second floor cover plate, which is supported by the cover plate frame and by the portion of the floor bridge panel that it overlies. The second cover plate is resiliently attached to the cover plate frame so that it can lift up and ride over the first cover plate when the gap narrows. The floor bridge panel is resiliently held down so that it cannot be dislodged altogether from the bearing receivers but can lift up and tilt relative to both floor portions. A movable transverse support beam supports the portion of the second cover plate that covers the portion of the recess not occupied by the floor bridge panel and into which the panel can move when the gap narrows.

58 Claims, 8 Drawing Sheets

SEISMIC EXPANSION JOINT COVER ASSEMBLY

BACKGROUND OF THE INVENTION

Seismic expansion joint covers for buildings in geographic regions that are prone to earthquakes are of special designs that allow for movements of the building elements on either side of the expansion gap that are very much greater than the movements that occur as a result of thermal expansion and contraction. In that regard, buildings currently being built in earthquake-prone regions are usually supported on isolators that attenuate the intensities of shocks imparted to the building structure but increase the durations and magnitudes of the swaying motions of the structure as it deforms when forces due to the earthquake are imposed on its foundation supports. When a building is composed of two or more adjacent independent structural units, each structural unit is subject to movements in an earthquake that are different in direction, frequency and magnitude. This is the case, indeed, regardless of whether the units are mounted on isolators or not. Adjacent structural units of a building are, accordingly, subject to large relative movements having components toward and away from each other (perpendicular to the gap) and components parallel to the gap. Because the connections between structural units at expansion joints (which might better be termed "motion-absorbing gaps") occur at the perimeters of the structural units, the movements include small but meaningful relative displacements vertically and angularly between floor portions on opposite sides of gaps due to the rocking of the floors at the perimeter of the structural unit about a fulcrum in the region of the bottom center of the structural unit Most seismic expansion joint covers follow traditional design philosophies that have long been applied to expansion joint covers that are not intended to sustain earthquakes; they use metal covers and various fastening systems to join the covers to frame members that are attached to the building members on either side of the expansion gap in such a way as to retain the covers in place in the gap during seismic events while permitting the large motions of the members. In a common fastening system, the cover is attached by bolts to the centers of spaced-apart bridge bars that span the gap with their ends sliding in trackways in the frame members. As the gap expands and contracts, the bridge bars pivot about the connecting bolts. An example of a seismic expansion joint cover system that uses bridge bars is found in U.S. Pat. No. 5,078,529 (Moulton, Jan. 7, 1992).

Previously known seismic expansion joint covers can sustain relatively weak seismic events but are severely damaged, often beyond repair, in severe seismic events, such as the one that occurred in January, 1994, just north of Los Angeles. An inspection of several installations in buildings near the 1994 earthquake of seismic expansion joint covers of various designs revealed bent and mangled covers, failed connectors, frames ripped from their anchors in the walls and floors, and damage to the walls adjacent the covers caused by impacts of the partially detached covers against the walls. Few of the inspected installations were repairable.

SUMMARY OF THE INVENTION

One object of the present invention is to provide a seismic expansion joint cover assembly for floors that is able to sustain a severe earthquake with little likelihood of damage to the components of the assembly or to the floor portions in is installed. Another object is to provide an expansion joint cover assembly that can be quickly and easily restored to its normal operating configuration after it has been disturbed by an earthquake. Still another object is to provide an expansion joint cover that has a level, essentially smooth upper surface and that is attractive in appearance.

The foregoing objects are attained, in accordance with the present invention, by a seismic expansion joint cover assembly that is designed to span a gap between first and second portions of a floor on opposite sides of the gap and that permits movements of the floor portions substantially horizontally toward and away from each other along an axis perpendicular to the gap and movements of the floor portions substantially horizontally relative to each other along an axis parallel to the gap. The assembly comprises a first elongated retainer adapted to be affixed to the first portion of the floor and extending parallel to the second axis, a second elongated retainer adapted to be affixed to the second portion of the floor and extending parallel to the first axis, and a rectangular floor bridge panel adapted to span the gap in all relative positions of the first and second floor portions and having a first end, a second end and spaced apart sides. A first elongated linear slide bearing arrangement interposed between the floor bridge panel adjacent the first end and the first retainer permits the first floor portion to move relative to floor bridge panel in the direction of the second axis. A second elongated linear slide bearing arrangement interposed between the floor bridge panel adjacent the second end and the second retainer permits the second floor portion to move relative to floor bridge panel in the direction of the first axis. Each of the bearing arrangements includes an elongated generally U-shaped bearing receiver having spaced apart leg portions forming a guideway and oriented with the guideway facing generally vertically and an elongated bearing received in the guideway of the bearing receiver. A cover plate frame is provided for attachment to the second floor portion and has side members closely adjacent the sides of the floor bridge panel and an end member spaced apart from the second end of the floor bridge panel so as to permit movement of the second floor portion relative to the floor bridge panel in the direction of the first axis when the gap narrows. A first cover plate is supported by a portion of the floor bridge panel proximate to the first floor portion. A second cover plate is supported by the cover plate frame and by a portion of the floor bridge panel. The first and second cover plates have surfaces flush with each other and adjacent edges spaced apart from each other to permit normal movements of the floor portions due to thermal expansion and contraction. The second cover plate is resiliently attached to the cover plate frame such as to keep it in place horizontally while permitting it to lift from supported relation on the floor bridge panel and move over a portion of the first cover plate in an earthquake.

In its broadest aspects, the cover assembly of the present invention has a floor bridge panel that is supported by two bearing arrangements arranged mutually perpendicularly and forming generally a "T." The floor bridge cover is a structural bridge across the gap. The bearing on the first floor portion acts parallel to the gap and allows the first floor portion to move sideways relative to the floor bridge panel; the bearing on the second floor portion acts perpendicular to the gap and allows the second floor portion to move relative to the floor bridge panel, which is fixed against movement perpendicular to the gap by the first bearing arrangement. The cover panel frame defines a space in the second floor portion of a size perpendicular to the gap such as to allow the floor bridge panel to move relative to the second floor portion when the gap narrows—that is, the floor bridge panel moves toward the end of the cover plate frame into a normally open space when the gap narrows in an earthquake.

The floor cover plates provide the floor surface over which persons and objects move across the assembly. Although it is feasible to mount the assembly on the surfaces of the floor portions with ramps leading up from the floor surfaces at each end, in virtually all installations, the retainers and cover frame are recessed into the floor portions below the surfaces of the floor portions on opposite ends of the assembly. Accordingly, the upper surfaces of the floor cover plates are level with the surfaces of the floor portions. Advantageously, therefore, the surfaces provided by the cover plates are level and substantially free of gaps. The function of the second cover plate is to bridge the space between the end of the floor bridge panel and the region provided within the cover plate frame for movement of the floor bridge plate from its normal position (no earthquake) to its position when the gap narrows in an earthquake. In all relative positions of the floor portions, that is, in the normal position, all positions when the gap narrows and all positions when the gap widens, the second cover plate functions to maintain a level surface across the cover assembly.

The use of only two mutually perpendicular bearings to support the floor bridge panel minimizes frictional resistance to movements of the floor portions relative to the floor bridge panel. Minimum resistance to movements ensures that the system will not bind and be damaged or destroyed in an earthquake, which is believed to be the primary reason why previously used seismic expansion joint covers have failed.

As mentioned above, the first and second linear guide bearing receivers are channel-shaped, each having a base portion and spaced-apart leg portions defining a guideway that faces vertically. The first and second bearings are members received in the guideways. That form of bearing allows for vertical displacements of either of the floor portions relative to the floor bridge panel, which can result from even slight tipping or skewing of the floor portions from level planes as the building parts sway. The vertical displacements permitted by the bearings eliminate potentially damaging stresses or seizing of the bearings. Preferably, the side surfaces of the bearings are in sliding clearance with the leg portions of the receivers, which also allows tilting and skewing motions and prevents seizing. Either or both of the guide bearing receivers and the bearings may be made of a high density low friction polymeric material, such as polypropylene, nylon, or "Delrin." While the receivers can be mounted on the retainers and the bearings on the floor bridge panel, it is preferable to mount the bearings on the retainers and the receivers on the floor bridge panel so that the channel-shaped guideways open vertically downwardly and cannot collect dirt over the years, which might impair their operability.

The second linear guide bearing arrangement is, preferably, located substantially equidistant from the sides of the floor bridge panel. Additionally, side linear slide bearings are interposed between the side members of the floor cover frame and the sides of the floor bridge panel. The side linear slide bearings have side leg portions in lateral clearance with the respective sides of the floor bridge panel and bottom leg portions normally in vertical clearance from the undersides of the floor bridge panel. The primary support for the floor bridge panel is, accordingly, provided by the center bearing on the second floor portion and the bearing on the first floor panel. The side bearings stabilize and support the floor bridge panel under heavy loads and under some conditions of relative movement, such as tilting of one floor portion relative to the other. When movements in an earthquake are predominantly horizontal, the side bearings are in clearance from the floor bridge panel. The side linear slide bearings may be of any suitable high density low friction polymeric material.

It is desirable to minimize the weight of the floor bridge panel in order to correspondingly minimize inertial forces, but it must also be strong and rigid to carry loads of persons and equipment moving across it and the forces imposed on it by the floor portions in an earthquake, which are due mainly to inertia and friction. To that end, a preferred construction for the floor bridge cover includes a peripheral frame having side members along the sides and end members along the ends and panel members joined to the frame and composed of a honeycomb core sandwiched between top and bottom sheets. The floor bridge cover may also have one or more transverse frame members extending between the side members and located intermediate the end members and one or more lengthwise frame members extending between the end members and located intermediate the side members. The second bearing receiver is, preferably, affixed to a lengthwise frame member. The adjacent edges of the floor cover members may overlie a transverse frame member.

As described above, the bearings that support the floor bridge panel are received in U-shaped receivers. Accordingly, the bearings can be displaced upwardly out of fully seated relation to the receivers to accommodate limited vertical translatory and tilting motions of one floor portion relative to the other, which motions are likely to occur due to rocking of the floors and the inherent slight tilting resulting from rocking motions. To prevent total separation of the floor bridge panel support bearings from the receivers, arrangements are included for resiliently restraining the floor bridge panel against upward movements relative to the first and second floor portions while permitting the floor bridge panel to displace upwardly in the event of vertical or tilting movements of the floor portions on either side of the gap relative to each other in an earthquake. One such arrangement includes members resiliently supported by the first retainer and the cover plate frame engaging portions of the floor bridge panel. For example, each side member of the peripheral frame of the floor bridge panel may have a side flange portion projecting outwardly, and a side cap member having a portion overlying each side flange portion is resiliently fastened to the corresponding side member of the floor cover frame so as to normally retain the floor bridge panel against upward displacement while permitting the floor bridge panel to displace upwardly in the event of vertical or tilting motions of one floor portion relative to the other. Similarly, the end member of the peripheral frame of the floor bridge panel adjacent the first floor portion may have an end flange portion projecting outwardly, and an end cap member having a portion overlying the end flange portion is resiliently fastened to the first retainer.

A convenient and effective way of affixing the first cover plate to the floor bridge panel is by means of hook and loop fasteners. Likewise, the sides of the second cover plate and the end of the second cover plate that is nearer to the first cover plate may also be affixed to the cover plate frame and the floor bridge panel, respectively, by hook and loop fasteners. The hook and loop fasteners between the second cover plate and the cover plate frame and floor bridge panel are released in an earthquake to allow the floor bridge panel to slide partly out from under the second cover plate when the gap widens and the second cover plate to slide over the first cover plate when the gap narrows in an earthquake. Low friction elements, such as "Teflon" tape strips or coatings, are provided on the underside of the second cover plate, to minimize friction when the floor bridge panel slides partly out from under the second cover plate and when the second cover plate and rides over the first cover plate as the gap widens and narrows.

It will often be desirable or necessary to provide one or more movable transverse beams to support the second cover plate intermediate the second end of the floor bridge panel and the end member of the cover plate frame. Each transverse beam extends between and is slidably supported by the side members of the cover plate frame. Control arms move the transverse beam toward and away from the end member of the cover frame upon and in a proportional relationship of one-half to movements of the second floor portion relative to the floor bridge panel. In a preferred arrangement, at least two slide members are slidably received on the transverse beam, a first control arm is pivotally connected between the end member of the cover plate frame and each slider, and a second control arm is pivotally connected between the end of the floor bridge panel and each slider. A linear slide bearing, such as a member of a high density low friction polymeric material, is interposed between each slider and the transverse beam. The upper surface supporting the second floor cover plate should be of a low friction material so that the beam may slide as freely as possible along the second cover plate. Similarly, linear bearings of a high density low friction polymeric material should be interposed between the transverse beam and the side members of the cover plate frame.

It is preferable that the first retainer and the first linear guide bearing receiver be substantially coextensive in the lengthwise direction of the gap with the floor bridge panel in positions of the floor bridge panel at maximum expected displacements of the first floor portion in the lengthwise direction of the gap relative to the floor bridge panel. In other words, the first retainer and bearing receiver extend laterally from either side of the floor bridge panel a distance not less than the expected maximum lateral excursion of the second floor portion relative to the first floor portion.

For a better understanding of the invention, reference may be made to the following description of an exemplary embodiment, taken in conjunction with the accompany drawings.

DESCRIPTION OF THE EMBODIMENT

The embodiment is configured for installation in a passageway between first and second floor portions F1 and F2 on either side of a motion-absorbing gap G between two structural units of a building, the two units being designed so that they are able to sway toward and away from each other perpendicular to the gap and from side to side parallel to the gap in an earthquake. Commonly, but not necessarily, the two building units will be supported by isolators. The gap G is wide enough to prevent the units from ever making contact when they sway and may be from, say, 12 to 48 inches in width. Accordingly, the expansion joint cover assembly will be designed to permit total relative horizontal displacements of nearly twice those magnitudes both perpendicular to and parallel to the gap. For example, a cover for a gap of 40 inches will be designed to allow the gap to narrow to near 0 inches and to widen to nearly 80 inches.

The relative movements of the building units are of necessity accompanied by a small amount of tilting of the floor portions at the perimeter, and the tilting results in relative vertical movements and skewing such that the floor portions do not remain level. A seismic expansion joint assembly, according to the present invention, absorbs the relative horizontal, vertical and skewing displacements resulting from swaying of the units in an earthquake.

Figure 4A:
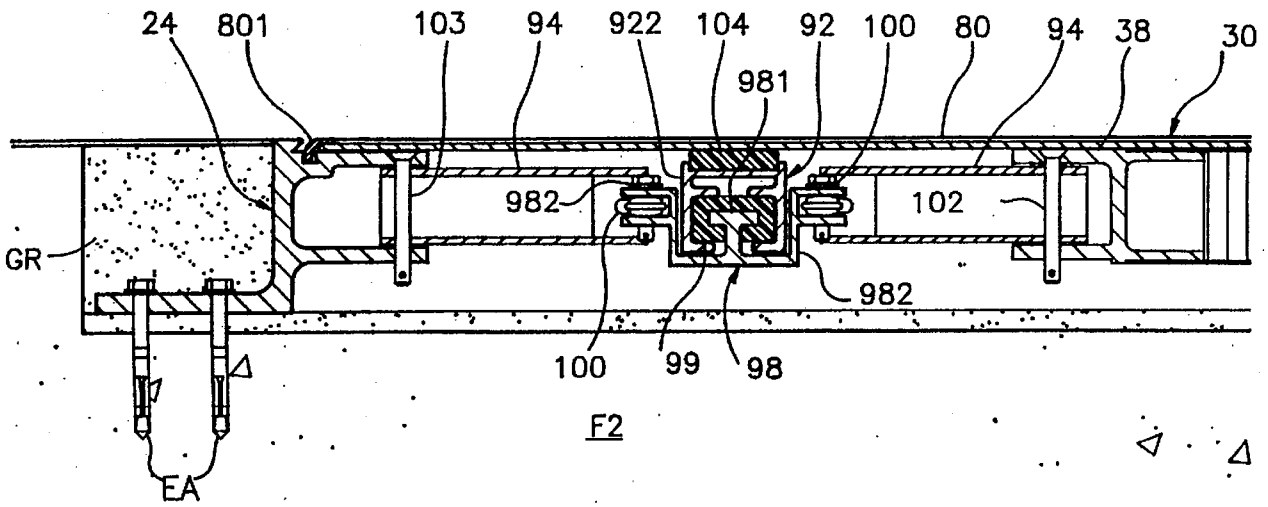
FIGS. 4A and 4B together make up a side cross-sectional view, with some details omitted, taken along the lines 4—4 of FIG. 1.
Figure 4B:
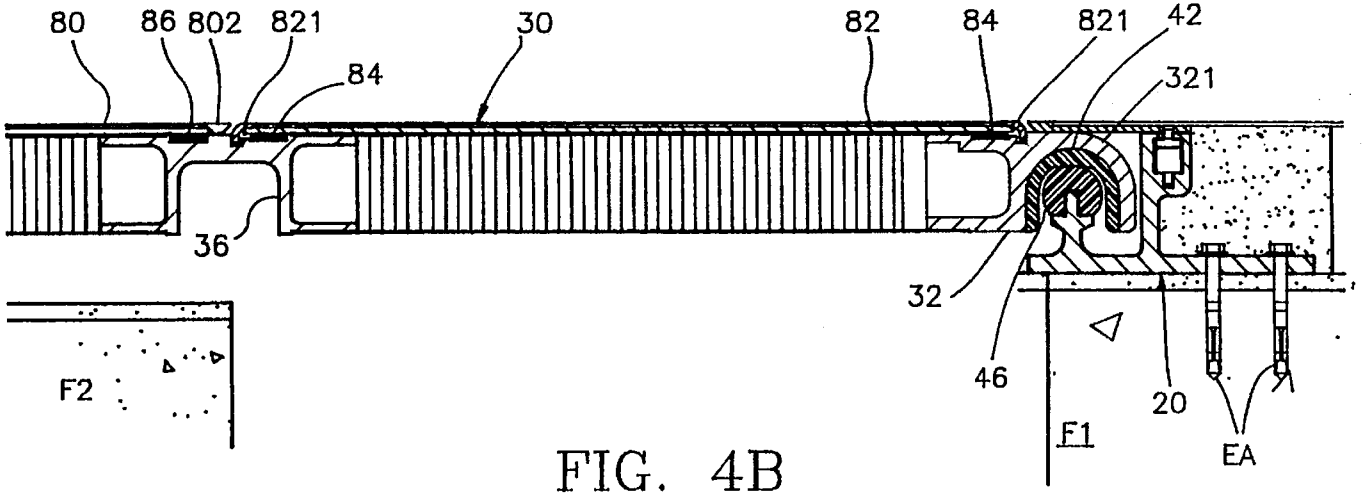
Figure 5:
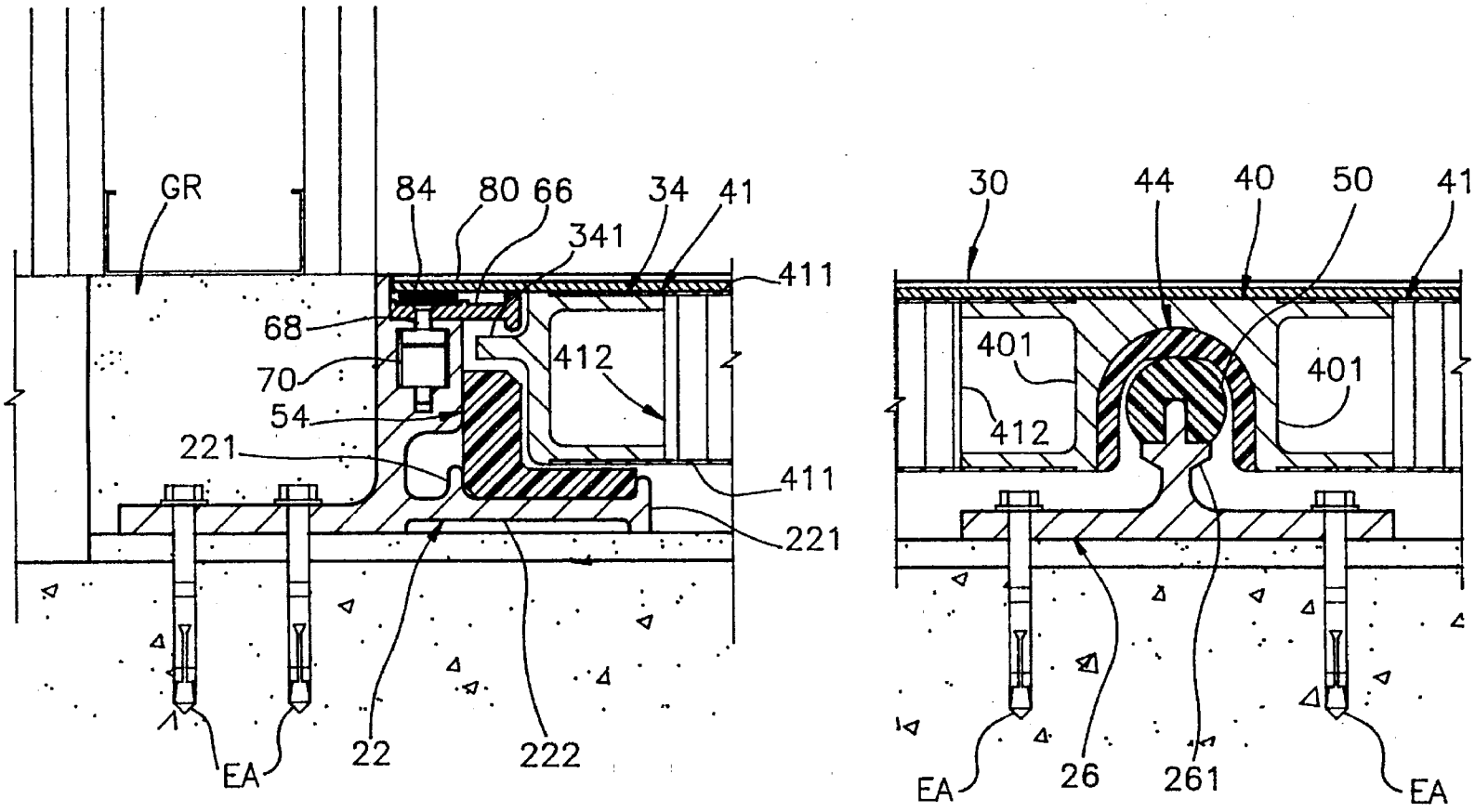
FIG. 5 is a partial end cross-sectional view, with portions broken away, taken along the lines 5—5 of FIG. 1.
Figure 6:
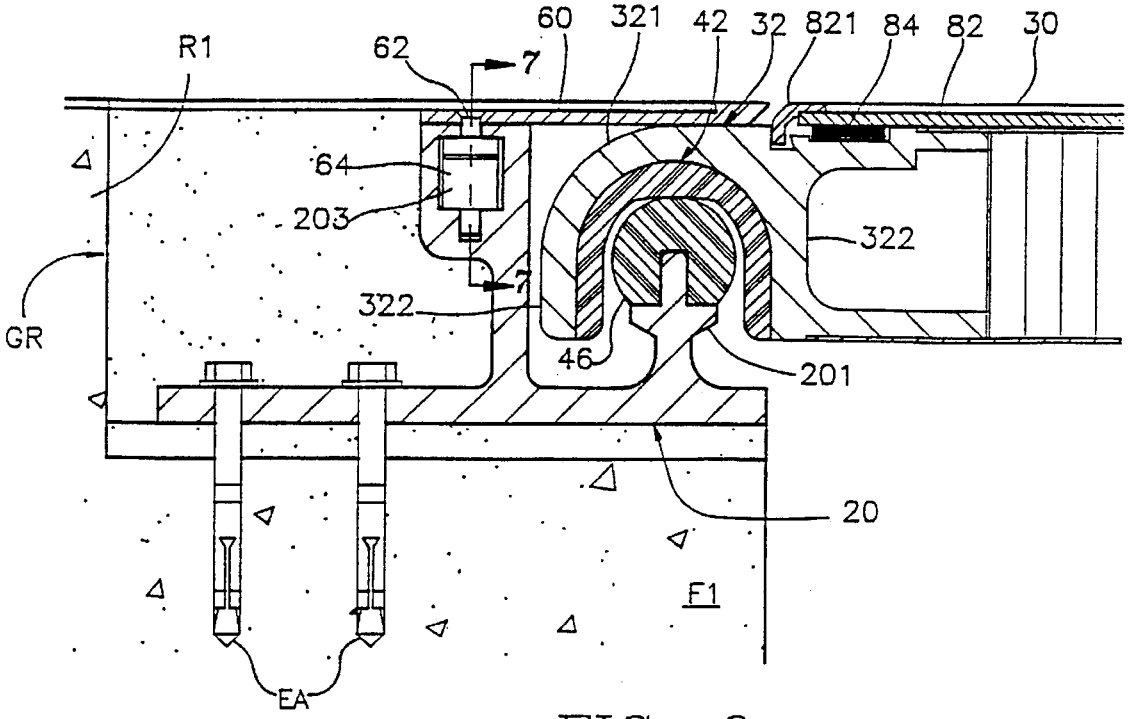
FIG. 6 is a fragmentary detail side cross-sectional view taken along the lines 6—6 of FIG. 1.
Figure 8:
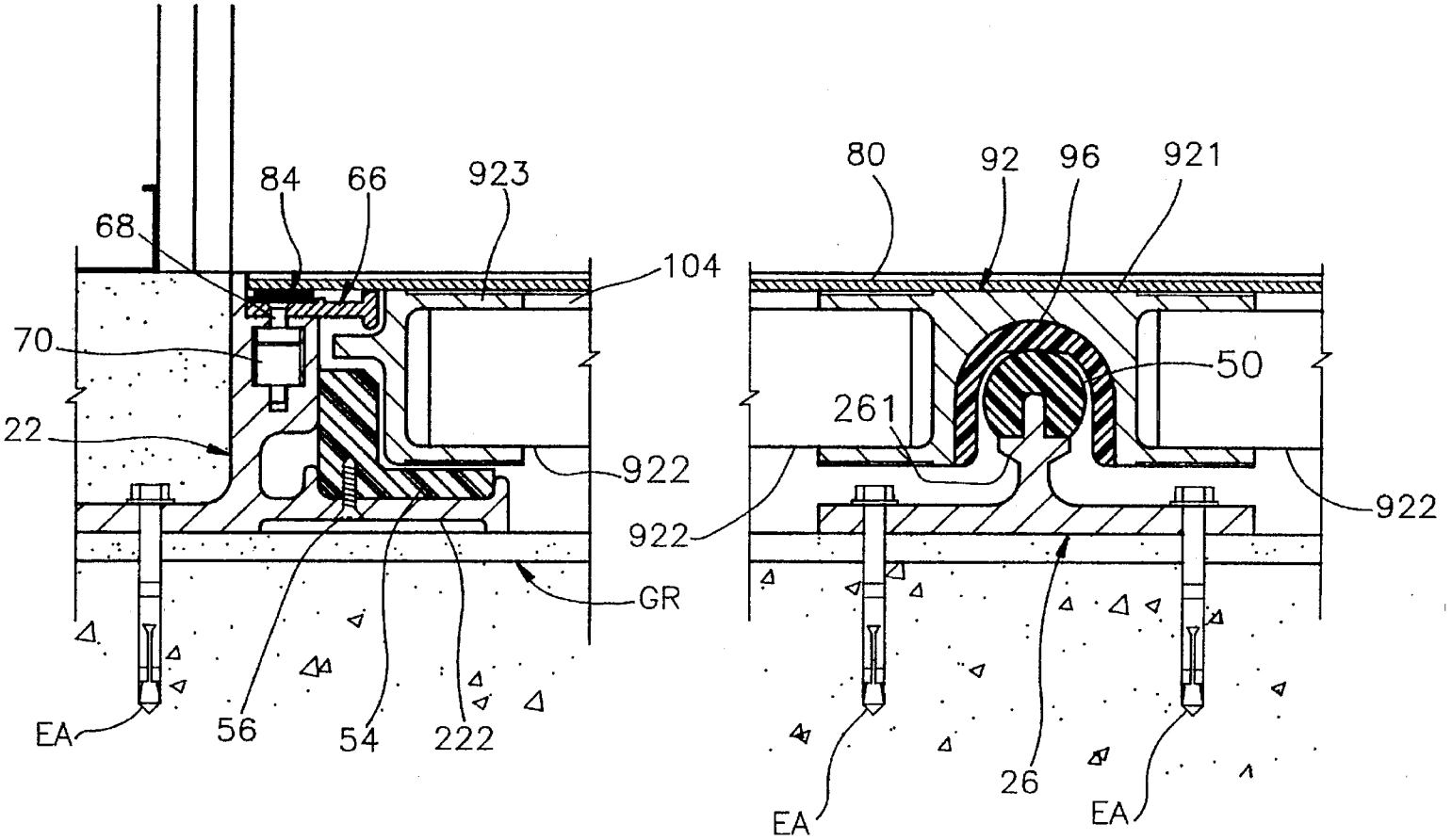
FIG. 8 is a partial end cross-sectional view, with portions broken away, taken along the lines 8—8 of FIG. 1.

The floor portion F1 is prepared to receive the assembly by forming a recess R1 along the edge of a length (along the edge of the gap), depth and width sufficient for reception of an elongated first retainer 20 (see FIGS. 6 and 4B). The floor portion F2 is prepared with a large rectangular recess R2 having a width (parallel to the gap), a length (perpendicular to the gap), and a depth sufficient to receive and to be bounded by a cover plate frame composed of side members 22 (FIGS. 5 and 8) and an end member 24 (FIG. 4A). A second retainer 26 (FIG. 5) runs along the center of the recess R2 from the edge of the floor portion F2 at the gap to the frame end member 24 and is positioned perpendicular to the gap. A leveling grout GR is applied to the surfaces of the cement floors below the retainers and cover plate frame, and the retainers and frame are fastened to the floors by expansion anchors EA. The parts of the recesses R1 and R2 outside the retainer 20 and the frame members 22 and 24 are back-filled with a grout GR to the level of the unfinished floor. Provision is made in the cover plates and other members of the assembly for a floor tile or other floor finishing material.

Most of the metal members of the assembly are aluminum extrusions and are, thus, of uniform cross-sections along their lengths. For the most part, it will be apparent from the drawings and the following description that suitable holes are drilled in the components for various fasteners. Where the metal members are joined to each other, the connections may be made at butt or bevel joints by welding or using angles and fasteners. The following description generally does not include references to holes and other details, such as connections, that are readily apparent or matters of ordinary design skill.

Figure 9:
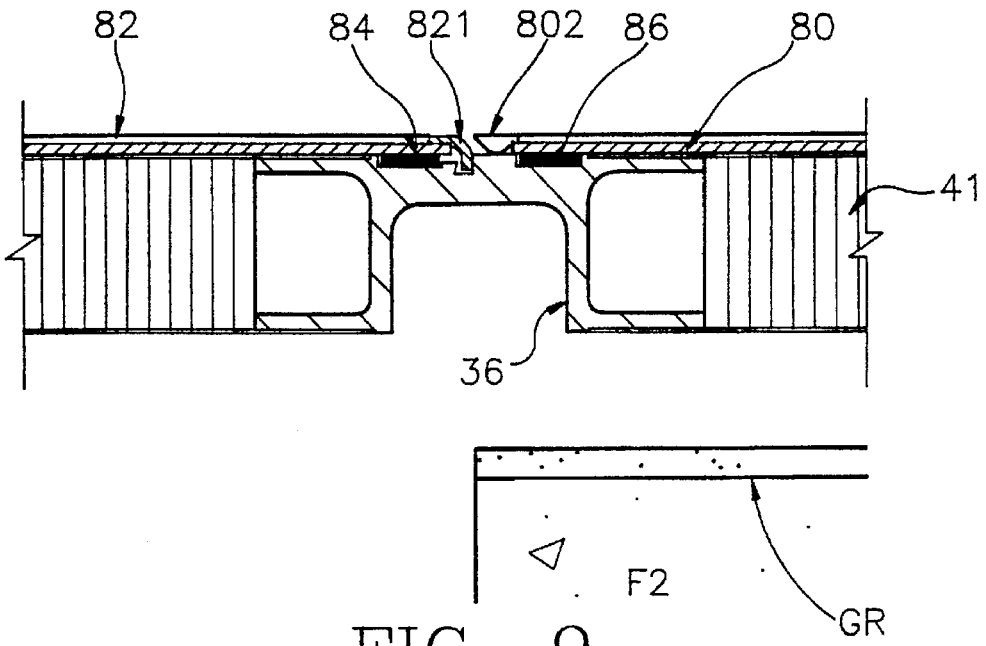
FIG. 9 is a fragmentary detail cross-sectional view taken along lines 9—9 of FIG. 1.

A major component of the assembly is a floor bridge panel 30 which spans the gap in all positions of the floor portions F1 and F2 relative to each other. The panel 30 is built up from a panel frame having a first end member 32, side members 34, transverse intermediate members 36, a second end member 38, and a longitudinal intermediate member 40. The transverse intermediate members 36, which are aligned with each other, are located generally above the edge of the floor portion F2 at the gap G at the normal or nominal spacing between the floor portions F1 and F2. The longitudinal intermediate member 40 extends the full length of the floor bridge panel and is joined at its ends to the respective end members 32 and 38. The side members 34 also extend the full length of the panel between the end members. All of the frame members are suitably connected where they meet. The spaces defined by the frame members receive sandwiches 41 (e.g., FIGS. 5 and 9) consisting of sheets 411 of a metal, such as aluminum, or a composite material (fiber and binder) on both faces and a honeycomb core 412 bonded to the sheets. The edges of the sandwich sheets overlap the faces of the frames around them and are bonded adhesively where they overlap. The floor bridge panel is strong and rigid and yet light in weight. In many cases, it will be desirable to fabricate the floor bridge panel in two or more modular parts that are small enough to be moved into the building and up to the floor where they are to be installed after the building is built and partly finished and joined together at the place of installation.

The first end member 32 (FIGS. 4B and 6) has a flange portion 321 having downwardly projecting flanges 322 forming a channel that receives a bearing receiver 42 of a high density low friction polymeric material, such as polypropylene. A similar bearing receiver 44 (FIG. 5) is received in a channel formed by flanges 401 of the longitudinal intermediate member 40. Each bearing receiver 42, 44 extends the full length of the member to which it is fitted, is of substantially U-shape in cross-section, and is received between the flanges 322, 401 of the members 32, 40. The bearing receivers are subject to large cross-wise forces, and the flanges 322, 401 stabilize the bearing receivers against the lateral loads.

The bearing receiver 42 (FIG. 6) receives a bearing 46 that is supported by an upwardly projecting T-shaped rib portion 201 of the first retainer 20 and is fastened in place by screws (not shown). Similarly, the bearing receiver 44 (FIG. 5) receives a bearing 50 that is supported on a T-shaped rib portion 261 of the second retainer 26 and is fastened in place by screws (not shown). In each case clearances are left between the sides of the bearings and the sides of the bearing receivers to allow for relative tilting motions. Like the bearings, the receivers are also formed of a high density low friction polymeric material. It is also possible for either the bearing or the receiver of each bearing arrangement to be of metal—that is, only one of the two parts in sliding relation is of a low-friction polymeric material.

In the normal state of the assembly, the sides of the floor bridge panel 30 are unsupported, but side slide bearings 54 (see left part of FIG. 5) of L-shaped cross-section and of a high density low friction polymeric material extend the full length of each side member 22. Each side bearing 54 is nested in a channel formed by a rib 221 that extends up from an arm 222 of the frame member 22 and is fastened to the frame member by screws (not shown). (FIG. 5 is the mirror image of the opposite side of the assembly.) Under heavy loads and under some conditions in an earthquake, the panel may tilt to one side or the other so as to bring the horizontal surfaces of the bearings 54 and the frame members 34 into contact. The side slide bearings 54 can be viewed as "outriggers" for stabilizing the panel in case of tilting motions relative to the floor portion F2. The side bearings 54 are also not intended to bear lateral loads except in unusual conditions. In most conditions, the mutually perpendicular bearings 42 and 44 support the floor bridge panel vertically and guide it horizontally.

Figure 7:
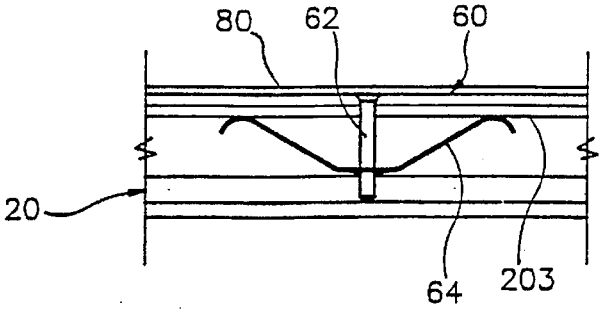
FIG. 7 is a fragmentary detail cross-sectional view taken along lines 7—7 of FIG. 6.

It is apparent that the relationships of the bearings 42, 44 and 54 and the members that slide along them provide no resistance to upward movement of the floor bridge panel, which is intentional in order to allow limited upward displacement of the panel from the retainers to accommodate tilting and vertical relative motions of the floor portions F1 and F2. To prevent complete detachment of the floor bridge panel from the retainers, the floor bridge panel 30 is resiliently restrained in a downward direction (see FIG. 6) by reception of the flange portion 321 of the panel frame end member 32 under an end top cap 60, which is fastened by screws 62 to leaf springs 64 received in a cavity 203 in the first retainer 20 (FIGS. 6 and 7). Essentially the same arrangement is provided by side top caps 66, screws 68 and leaf springs 70 (FIGS. 5 and 8), the side top caps capturing a projecting rib 341 of the side frame members 34 of the floor bridge panel 30. Several spring attachments located at intervals are provided. Because the springs 70 are blind, they are pre-installed in the receiving cavities. The springs 64 and 70 yield to enable the top caps to be lifted up by the floor bridge panel, but complete dislodging of the floor bridge panel is prevented.

The floor bridge panel 30 is retained by the bearing 42 and the bearing receiver 46 in a substantially stationary position in a direction perpendicular to the gap G. Accordingly, when the gap narrows and widens in an earthquake, the floor bridge panel moves horizontally into and out of the recess R2 within the cover plate frame in the second floor portion. The recess R2 is, therefore, long enough in the direction perpendicular to the gap to permit the panel to move with the floor portion F1 toward the end member 24 of the cover plate frame to the maximum extent of the excursion of the floor bridge panel. The open part of the recess R2 that exists between the second end frame member 38 of the panel 30 and the end member 24 of the cover plate frame in the normal or nominal position of the assembly is covered by a second cover plate 80 when the gap widens to its maximum extent. To maintain the floor level across the joint cover assembly, a first cover plate 82 is received on the portion of the floor bridge panel 30 that the spans the gap in the normal state (FIG. 4B shows the normal state of the assembly and gap).

The ends of the two cover plates 80 and 82 nearest each other (FIG. 4B) form an expansion/contraction gap above the transverse intermediate frame, the gap allowing for thermal expansion and contraction of the two structural units on either side of the gap G. When the amounts of thermal expansion and contraction or other conditions require, an extensible/compressible gasket can be provided between the ends of the first and second cover plates. The first cover plate 82 is stationary with respect to the first floor portion F1, and movements are accommodated by displacements of the second cover plate 80 relative to the floor portion F1 and the floor bridge panel 30.

The first cover plate 82 has lips 821 (see, e.g., FIGS. 6 and 9) along both ends, which extend down into grooves in the frame members and keep the cover plate in place horizontally in the lengthwise direction. The lips 821 may be provided by separate strips welded to a plate that forms the cover, thus leaving a border for floor tiles. The cover plate is suitably fastened down on the floor bridge panel 30 at the ends and on the side top caps 66 at the sides, such as by strips or swatches of hook and loop fasteners 84 secured by adhesives and set into recesses formed in panel frame members and the side top caps.

Figure 10:
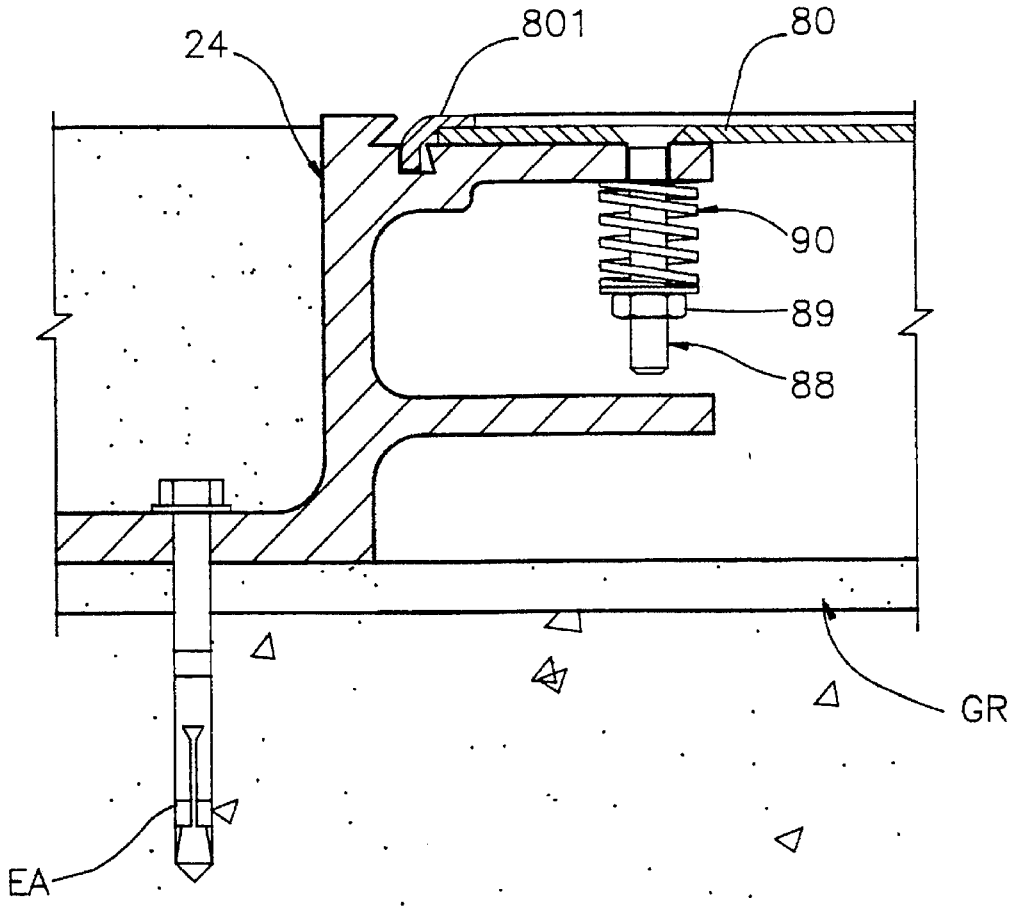
FIG. 10 is a fragmentary detail cross-sectional view taken along lines 10—10 of FIG. 1.

The second cover plate 80 has a lip member 801 at its end farther from the gap G (FIG. 10) that is received in a groove in the frame member 24 and is fastened down by hook and loop cloth fasteners 86 to the side cap members 66 and the intermediate member 36 of the cover plate frame. The end of the second cover plate closer to the gap G has a nose 802 (FIG. 9) having a surface that slopes down and away from the adjacent end of the first cover plate 82 so as to provide a camming action when it engages the end of the first cover plate 82. The camming action lifts the second cover plate 80 up so that it can ride over the upper surface of the first cover plate 82 when the gap G narrows. When the gap G widens, the second cover plate 80 moves with the second floor portion F2 and slides along the surface of the floor bridge panel. Although some or all of the hook and loop fasteners by which the second cover plate is held down at the sides may release when the second cover plate lifts up, the second cover plate is kept in position horizontally on the second floor portion F2 by resilient connections formed at intervals between the end frame member 24 and the second cover plate 80 by bolts 88, nuts 89, and springs 90. Because the nuts 89 are blind (see FIG. 10), the springs and nuts are welded or otherwise fastened to the frame member 24 before the cover plate 80 is installed. The resilient connections allow the second cover plate to lift up when the floor bridge panel is lifted up and when the second cover plate rides over the first cover plate.

The cover plates 80 and 82 of the embodiment are aluminum and have a thickness (of the order of ¼ inch) sufficient to make them strong enough to carry large loads passing over the assembly. However, the span lengthwise across the part of the floor recess R2 between the cover plate end frame member 24 and the floor bridge panel 30 is large (usually at least 12 inches and often more) when the assembly is in its normal configuration (no earthquake) and is approximately doubled when the gap G narrows in an earthquake. Accordingly, the second cover plate 80 is supported by a transverse beam 92, which is movable along the recess in a proportion of one half to movements of the floor bridge panel 30 and is moved along the space by control arms 94. As may best be seen in FIG. 8, the beam 92 is a weldment composed of a center piece 921, which is a piece of, say, 3 in. in length, cut from the same extruded section as the longitudinal intermediate frame member 40 of the floor bridge panel 30, a pair of beam members 922, one extending out from each side of the center piece, and an end piece 923 at the outer end of each beam member, the end piece being a short piece cut from the same extruded section as the side members 34 of the floor bridge cover frame. The center piece 921 carries a bearing receiver 96 which receives the bearing 50 carried by the retainer 26, and the end pieces 923 run in clearance with the side slide bearings 54. Thus, the beam 92 moves endwise with low friction along the recess R2 in the same manner as the floor bridge panel 30. The resiliently restrained side caps 66 retain the beam 92 while permitting it to lift up.

Figure 1:
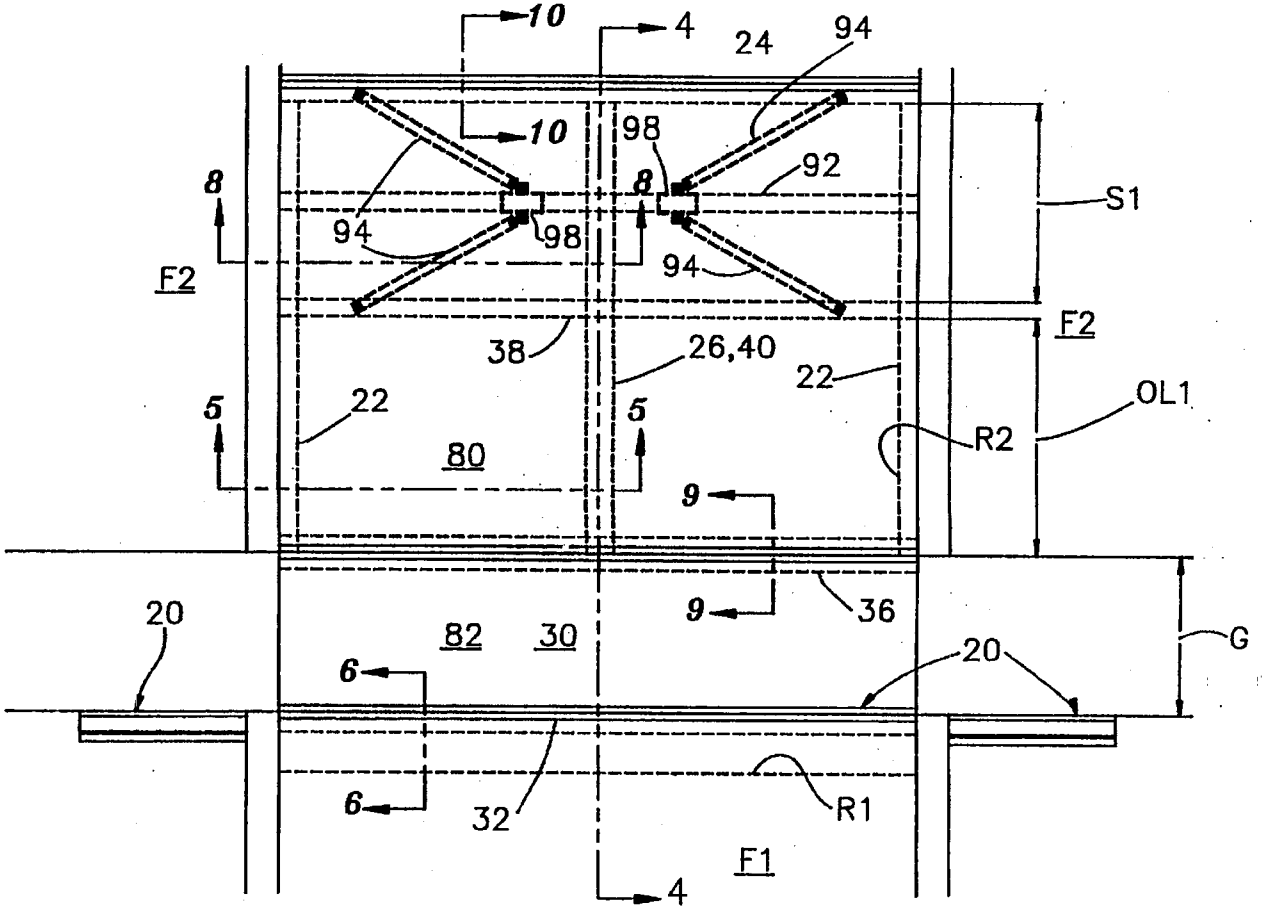
FIG. 1 is a simplified top plan view of the embodiment as installed in floor portions on opposite sides of a gap and showing the normal or nominal condition of the floor portions and the cover.
Figure 2:
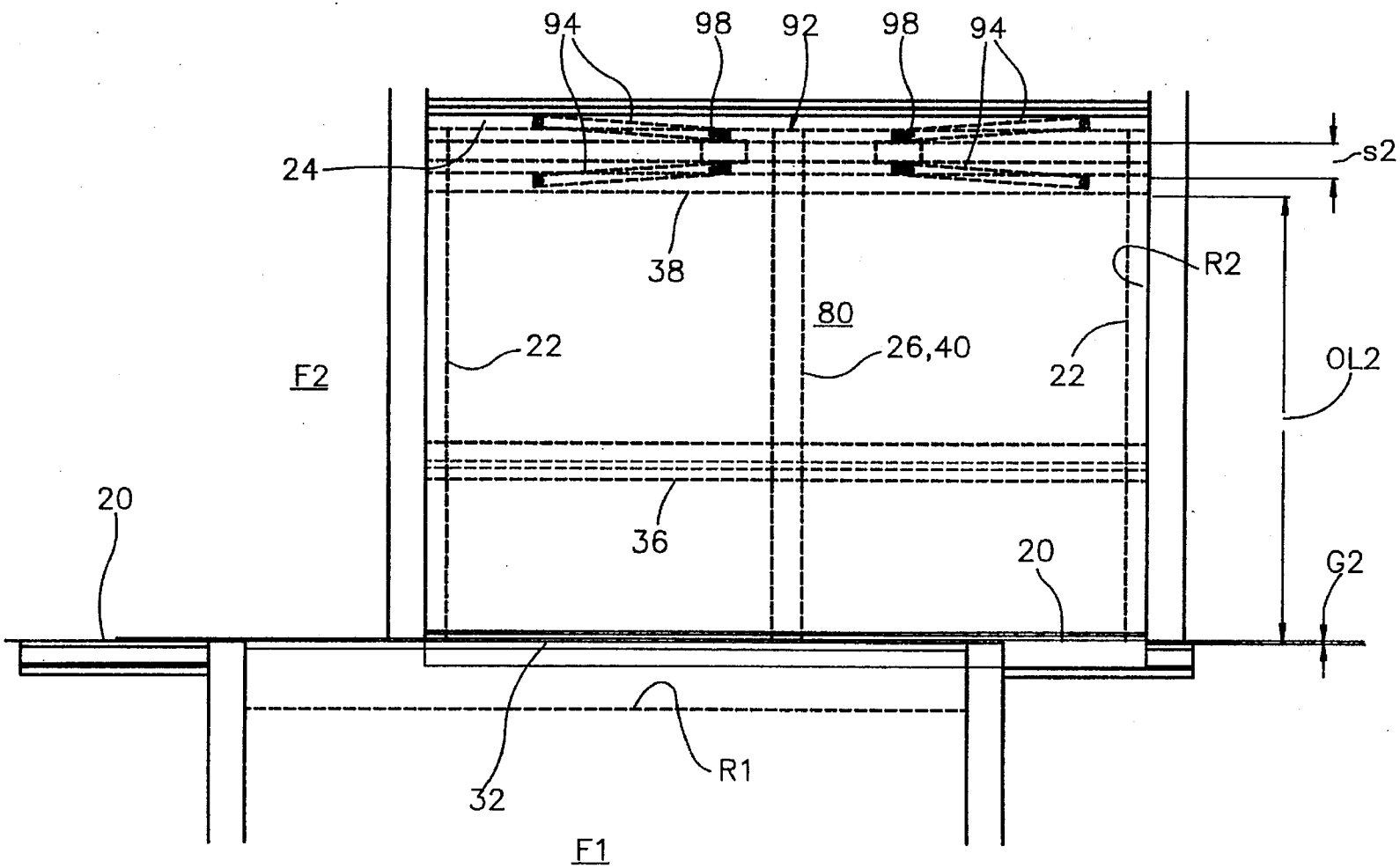
FIG. 2 is a simplified top plan view of the embodiment similar to FIG. 1 but shows the condition of the cover assembly when the floor portions have moved fully toward each other perpendicular to the gap and one floor portion has moved relative to the other floor portion to a maximum extent parallel to the gap.
Figure 3:
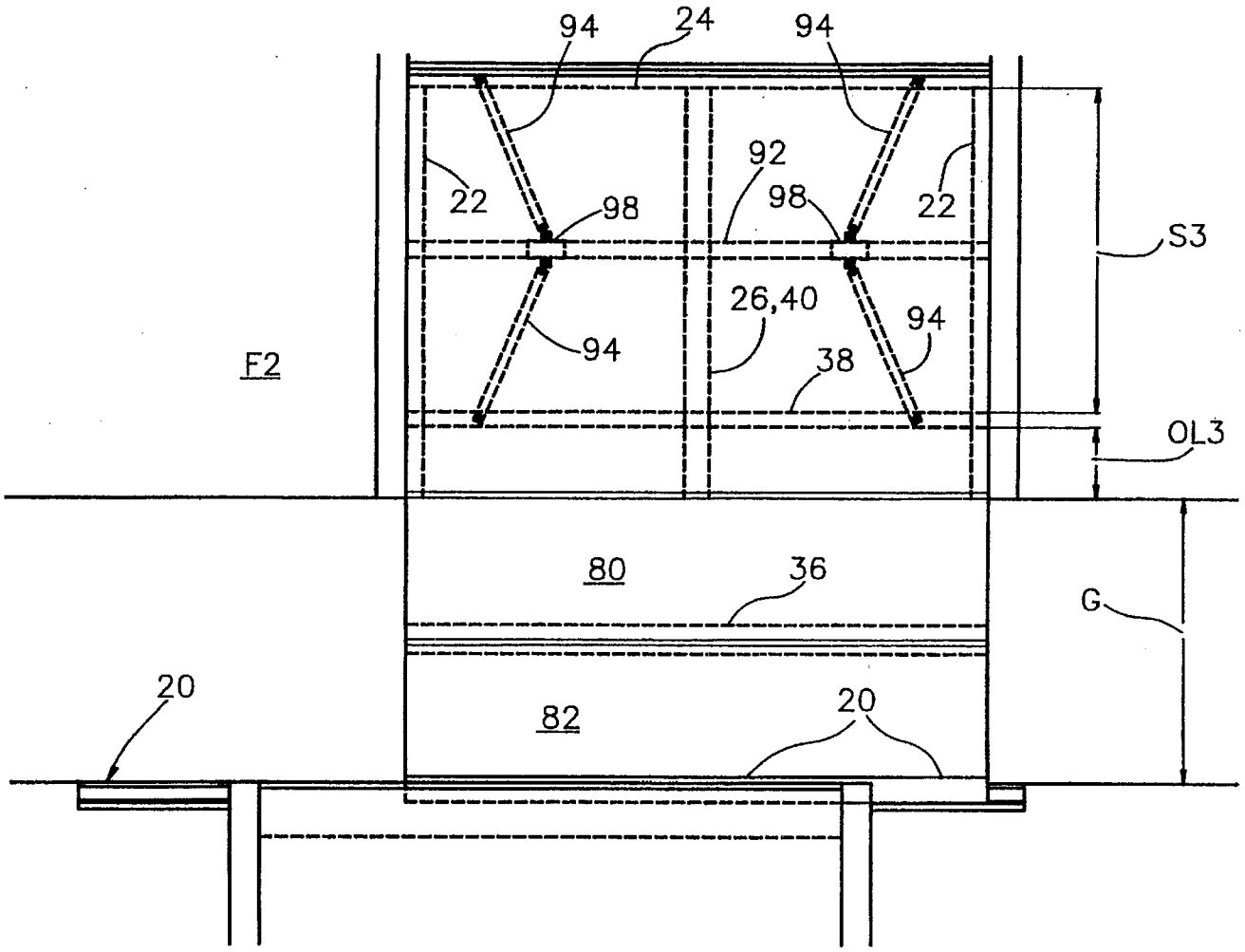
FIG. 3 is another simplified top plan view, which shows the condition of the cover assembly when the floor portions have moved fully away from each other perpendicular to the gap and one floor portion has moved to a maximum extent parallel to the gap.

Each beam member 922 receives a slider 98 (FIG. 4A), which has a T-shaped center arm portion 981 that slides within a C-shaped slide bearing 99 installed within the beam member 922. Each slider has coupling arm portions 982, each of which is coupled to one end of one of a pair of the control arms 94 by pivot couplings 100. The other end of one arm 94 is pivotally attached by a pin 102 to the end frame member 38 of the floor bridge panel. The other end of the other arm 94 is coupled by a pin 103 to the end frame member 24 of the cover plate frame. The control arms 94 respond to movements of the floor bridge panel relative to the second floor portion F2 by maintaining the beam 92 centered between the end frame member 24 and the end member 38 of the floor bridge panel 30, as shown in FIGS. 1 to 3. A bearing strip 104 of high density low friction material is attached to the upper surface of each beam member 922 to provide smooth running of the beam 92 along the undersurface of the second cover plate 80.

The normal position of the assembly is shown in FIG. 1. The floor bridge panel 30 bridges the gap G and provides structural support for the first cover plate 82 in an overlapping portion, marked OL1, of the second cover plate 80. The cover plates are level with the surfaces of the floor portions F1 and F2 so that persons and objects can move across the assembly without encountering any significant interruption in the traveling surface. The part of the second cover plate 80, which is marked S1, extending lengthwise over the open part of the recess R2 between the end of the floor bridge panel 30 and the end member 24 of the cover plate frame is supported by the movable beam 92.

In an earthquake, the gap G will narrow and widen in a direction perpendicular to the gap, as shown in FIGS. 2 and 3. The floor bridge panel 30 remains attached to the first floor portion F1 by the first bearing/ receiver/ retainer structure (FIG. 6). Accordingly, the second floor portion F2 slides perpendicular to the gap G relative to the floor bridge panel, the sliding movement being freely permitted in guided relation by the second bearing/ receiver, retainer structure (FIG. 5), perhaps aided by the side slide bearings 54. The control arms 94/ sliders 98 move the beam 92 lengthwise to keep it centered lengthwise in the varying length spaces, e.g., S2, S3, for good support of the second cover plate in all positions of the floor bridge panel 30 relative to the second floor portion F2. As described above, the second cover plate 80 remains attached to the end member 24 of the cover plate frame, the beam 92 and the floor bridge panel/ first cover plate sliding farther under it, overlap OL2, when the gap narrows (G2, FIG. 2) and retracting from under it, overlap OL3, when the gap widens (G3, FIG. 3).

The first floor portion F1 may also move from side to side from the nominal position in both directions parallel to the gap G relative to the second floor portion F2 in an earthquake. Such movements are accommodated by sliding of the first floor section F1 sideways relative to the floor bridge panel 30 (FIGS. 2 and 3), the sliding movement being freely permitted by the first bearing/ receiver/ retainer structure interposed between the floor bridge panel and the first floor portion. The floor bridge panel is held against lateral movements parallel to the gap G by the second bearing/ receiver/ retainer structure by which the floor bridge panel is laterally attached to the second floor portion. The side slide bearings may assist in retaining the floor bridge panel in a fixed position, relative to the second floor portion F2.

It is apparent that motions both parallel to and perpendicular to the gap may (and almost certainly will) occur simultaneously and that the assembly readily permits both movements. The function of the assembly in response to vertical and tilting relative movements of the floor portions is discussed above.

Ordinarily, the cover assembly should return to its normal condition after an earthquake without any servicing other than pressing the first cover plate 80 down along the sides and end to secure the hook and loop fasteners. If there is damage, the first cover plate 80 can be removed by taking out the bolts 88 by which it is fastened to the end member 24 of the cover frame (see FIG. 10) and lifting it up. The floor bridge panel 30 can be removed by taking out the bolts 62 (FIG. 6) and removing the end top cap 60 and the bolts 68 and removing the side top caps 66 (FIG. 5). The floor bridge panel is then free the be lifted from the retainers. The assembly can also be taken apart for inspection, cleaning or other servicing during its life by the same relatively easy procedure.

We claim:

1. A seismic expansion joint cover installation comprising first and second portions of a building floor spaced apart to define a gap between them, a rectangular floor bridge panel adapted to span the gap in all relative positions of the first and second floor portions and having a first end, a second end and spaced apart sides, first elongated linear slide bearing means interposed between the floor bridge panel adjacent the first end thereof and the first floor portion and supporting the floor bridge panel on the first floor portion for horizontal movement thereof relative to said first floor portion in the direction of a second axis parallel to the gap and for limited horizontal movement thereof in the direction of a first axis perpendicular to the second axis and for limited upward vertical movement thereof relative to the first floor portion, second elongated linear slide bearing means interposed between the floor bridge panel adjacent the second end thereof and the second floor portion and supporting the floor bridge panel on the second floor portion for horizontal movement thereof relative to second floor portion in the direction of the first axis and for limited horizontal movement thereof in the direction of the second axis and for limited upward vertical movement thereof relative to the second floor portion, a cover plate frame affixed to the second floor portion and having side members closely adjacent the sides of the floor bridge panel and an end member spaced apart from the second end of the floor bridge panel so as to permit movement of the floor bridge panel relative to the cover plate frame in the direction of the first axis, a second cover plate supported by the cover plate frame and by a portion of the floor bridge panel adjacent the second end thereof, and means for coupling the second cover plate to the cover plate frame for preventing horizontal movements of the second cover plate relative to the cover plate frame while permitting at least a portion of the second cover plate to lift from supported relation on the cover plate frame upon relative tilting movements of the floor portions and the floor bridge panel in an earthquake.

2. A seismic expansion joint cover installation according to claim 1 wherein each of the first and second bearing means includes an elongated generally U-shaped bearing receiver having spaced apart leg portions forming a guideway and oriented with the guideway facing generally vertically and including an elongated bearing received in the guideway of the bearing receiver.

3. A seismic expansion joint cover installation according to claim 2 wherein the bearing receivers of the first and second linear bearing means are attached to the floor bridge panel and the guideways open generally downwardly.

4. A seismic expansion joint cover installation according to claim 2 wherein the bearings of first and second bearing means are members extending upwardly and have upper surfaces engaging base portions of the receivers between the leg portions and side surfaces in clearance with the leg portions of the receivers.

5. A seismic expansion joint cover installation according to claim 2 wherein the guide bearing receivers are of a high density low friction polymeric material.

6. A seismic expansion joint cover installation according to claim 2 wherein the bearings are of a high density low friction polymeric material.

7. A seismic expansion joint cover installation according to claim 2 wherein the second bearing means is located substantially equidistant from the sides of the floor bridge panel.

8. A seismic expansion joint cover installation according to claim 1 and further comprising means for normally resiliently restraining the floor bridge panel against upward movement relative to the first and second floor portions.

9. A seismic expansion joint cover installation according to claim 1 and further comprising a first cover plate supported by a portion of the floor bridge panel adjacent the first end thereof, and wherein the first and second cover plates have surfaces substantially flush with each other and adjacent edges spaced apart from each other so as to be adapted to permit normal movements of the floor portions due to thermal expansion and contraction of the gap.

10. A seismic expansion joint cover installation according to claim 1 and further comprising side linear slide bearings interposed between the side members of the cover plate frame and the sides of the floor bridge panel.

11. A seismic expansion joint cover installation according to claim 10 wherein the side linear slide bearings have side leg portions normally in lateral clearance from the floor bridge panel and bottom leg portions normally in vertical clearance from the floor bridge panel.

12. A seismic expansion joint cover installation according to claim 10 wherein the linear slide bearings are of a high density low friction polymeric material.

13. A seismic expansion joint cover installation according to claim 10 wherein the floor bridge panel includes a peripheral frame having side members along the sides and first and second end members along the first and second ends, respectively, and panel members joined to the frame and composed of a core sandwiched between top and bottom sheets.

14. A seismic expansion joint cover installation according to claim 13 wherein the floor bridge panel further includes a lengthwise frame member located intermediate the side members, and wherein the bearing receiver of the second bearing means is affixed to the lengthwise frame member.

15. A seismic expansion joint cover installation according to claim 14 wherein the floor bridge panel further includes transverse frame members extending between the side members and the lengthwise frame member and located intermediate the first and second end members.

16. A seismic expansion joint cover installation according to claim 15 wherein adjacent edges of the first and second floor cover plates overlie a transverse frame member.

17. A seismic expansion joint cover installation according to claim 13 wherein each side member of the peripheral frame of the floor bridge panel has a side flange portion projecting outwardly, and further comprising a side cap member having a portion overlying each side flange portion and means resiliently fastening each side cap member to the corresponding side member of the cover plate frame so as to normally restrain the floor bridge panel against upward displacement while permitting the floor bridge panel to displace upwardly in the event of an earthquake.

18. A seismic expansion joint cover installation according to claim 13 wherein the first end member of the peripheral frame of the floor bridge panel has an end flange portion projecting outwardly, and further comprising an end cap member having a portion overlying the end flange portion and means resiliently fastening the end cap member to the first retainer so as to normally restrain the floor bridge panel against upward displacement while permitting the floor bridge panel to displace upwardly in the event of an earthquake.

19. A seismic expansion joint cover installation according to claim 9 wherein the first cover plate is affixed to the floor bridge panel by hook and loop fasteners.

20. A seismic expansion joint cover installation according to claim 1 wherein the second cover plate is affixed to members of the cover plate frame and the floor bridge panel by hook and loop fasteners.

21. A seismic expansion joint cover installation according to claim 1 and further comprising low friction elements on the undersurface of the second floor cover plate to minimize friction between the second floor cover plate and the floor bridge panel upon movement of the second floor cover plate relative to the floor bridge panel in an earthquake.

22. A seismic expansion joint cover installation according to claim 1 and further comprising a transverse beam supporting the second cover plate, extending between and slidably supported by the side members of the cover plate frame and located intermediate of the end member of the cover plate frame and the second end of the floor bridge panel, and control means for moving the transverse beam in the direction of the first axis upon and in a proportional relationship of one-half to movements of the second floor portion relative to the floor bridge panel.

23. A seismic expansion joint cover installation according to claim 22 wherein the control means includes at least two slide members slidably received on the transverse beam in spaced apart relation, a first pair of control arms, each pivotally connected between the end member of the cover plate frame and one of the sliders, and a second pair of control arms, each pivotally connected between the second end of the floor bridge panel and one of the sliders.

24. A seismic expansion joint cover installation according to claim 22 and further comprising a linear slide bearing interposed between each slider and the transverse beam.

25. A seismic expansion joint cover installation according to claim 22 wherein the linear slide bearing interposed between each slider and the transverse beam is of a high density low friction polymeric material.

26. A seismic expansion joint cover installation according to claim 22 wherein the transverse beam has an upper surface supporting a portion of the second floor cover plate, the upper surface being of a low friction material.

27. A seismic expansion joint cover installation according to claim 22 wherein linear bearings of a high density low friction polymeric material are interposed between the transverse beam and the side members of the cover plate frame.

28. A seismic expansion joint cover installation according to claim 22 and further comprising a beam support bearing affixed to the transverse beam and received by a bearing receiver of the second bearing means.

29. A seismic expansion joint cover assembly for spanning an elongated gap between first and second portions of a building floor on opposite sides of the gap, comprising a first elongated retainer adapted to be affixed to the first portion of the floor and defining a second axis, a second elongated retainer adapted to be affixed to the second portion of the floor and defining a first axis perpendicular to the second axis, a rectangular floor bridge panel adapted to span the gap in all relative positions of the first and second floor portions and having a first end, a second end and spaced apart sides, first elongated linear slide bearing means interposed between the floor bridge panel adjacent the first end thereof and the first retainer and supporting the floor bridge panel for movement relative to first retainer in the direction of the second axis, second elongated linear slide bearing means interposed between the floor bridge panel adjacent the second end thereof and the second retainer for supporting the floor bridge panel for movement relative to the second retainer in the direction of the first axis, each of the first and second bearing means including an elongated generally U-shaped bearing receiver having spaced apart leg portions forming a guideway and oriented with the guideway facing generally vertically and including an elongated bearing received in the guideway of the bearing receiver, a cover plate frame adapted to be affixed to the second floor portion and having side members closely adjacent the sides of the floor bridge panel and an end member spaced apart from the second end of the floor bridge panel so as to permit movement of the floor bridge panel relative to the cover plate frame in the direction of the first axis, a first cover plate supported by a portion of the floor bridge panel adjacent the first end thereof, a second cover plate supported by the cover plate frame and by a portion of the floor bridge panel adjacent the second end thereof, the first and second cover plates having surfaces substantially flush with each other and adjacent edges spaced apart from each other so as to be adapted to permit normal movements of the floor portions due to thermal expansion and contraction, and means for coupling the second cover plate to the cover plate frame for preventing horizontal movements of the second cover plate relative to the cover plate frame while permitting a portion of the second cover plate to lift from supported relation on the floor bridge panel and move over a portion of the first cover plate in an earthquake.

30. A seismic expansion joint cover assembly according to claim 29 wherein the bearing receivers of the first and second linear bearing means are attached to the floor bridge panel and the guideways open generally downwardly.

31. A seismic expansion joint cover assembly according to claim 30 wherein the bearings of first and second bearing means are members extending upwardly from the retainers and have upper surfaces engaging base portions of the receivers between the leg portions and side surfaces in clearance with the leg portions of the receivers.

32. A seismic expansion joint cover assembly according to claim 29 wherein the bearing receivers are of a high density low friction polymeric material.

33. A seismic expansion joint cover assembly according to claim 29 wherein the bearings are of a high density low friction polymeric material.

34. A seismic expansion joint cover assembly according to claim 29 wherein the second retainer and the second bearing means are located substantially equidistant from the sides of the floor bridge panel.

35. A seismic expansion joint cover assembly according to claim 29 and further comprising means for normally resiliently restraining the floor bridge panel against upward movement relative to the cover plate frame.

36. A seismic expansion joint cover assembly according to claim 35 wherein the restraining means includes members resiliently supported by the cover plate frame engaging portions of the floor bridge panel.

37. A seismic expansion joint cover assembly according to claim 29 and further comprising means for normally resiliently restraining the floor bridge panel against upward movement relative to the first retainer.

38. A seismic expansion joint cover assembly according to claim 37 wherein the restraining means includes members resiliently supported by the first retainer engaging portions of the floor bridge panel.

39. A seismic expansion joint cover assembly according to claim 29 and further comprising side linear slide bearings interposed between the side members of the cover plate frame and the sides of the floor bridge panel.

40. A seismic expansion joint cover assembly according to claim 39 wherein the side linear slide bearings have side leg portions normally in lateral clearance from the floor bridge panel and bottom leg portions normally in vertical clearance from the floor bridge panel.

41. A seismic expansion joint cover assembly according to claim 29 wherein the side linear slide bearings are of a high density low friction polymeric material.

42. A seismic expansion joint cover assembly according to claim 29 wherein the floor bridge panel includes a peripheral frame having side members along the sides and first and second end members along the first and second ends, respectively, and panel members joined to the frame and composed of a core sandwiched between top and bottom sheets.

43. A seismic expansion joint cover assembly according to claim 42 wherein the floor bridge panel further includes a lengthwise frame member located intermediate the side members, and wherein the bearing receiver of the second bearing means is affixed to the lengthwise frame member.

44. A seismic expansion joint cover assembly according to claim 43 wherein the floor bridge panel further includes transverse frame members extending between the side members and the lengthwise frame member and located intermediate the first and second end members.

45. A seismic expansion joint cover assembly according to claim 44 wherein adjacent edges of the first and second floor cover plates overlie a transverse frame member.

46. A seismic expansion joint cover assembly according to claim 42 wherein each side member of the peripheral frame of the floor bridge panel has a side flange portion projecting outwardly, and further comprising a side cap member having a portion overlying each side flange portion and means resiliently fastening each side cap member to the corresponding side member of the cover plate frame so as to normally restrain the floor bridge panel against upward displacement while permitting the floor bridge panel to displace upwardly in the event of an earthquake.

47. A seismic expansion joint cover assembly according to claim 42 wherein the first end member of the peripheral frame of the floor bridge panel has an end flange portion projecting outwardly, and further comprising an end cap member having a portion overlying the end flange portion and means resiliently fastening the end cap member to the first retainer so as to normally restrain the floor bridge panel against upward displacement while permitting the floor bridge panel to displace upwardly in the event of an earthquake.

48. A seismic expansion joint cover assembly according to claim 29 wherein the first cover plate is affixed to the floor bridge panel by hook and loop fasteners.

49. A seismic expansion joint cover assembly according to claim 29 wherein the second cover plate is affixed to members of the cover plate frame and to the floor bridge panel by hook and loop fasteners.

50. A seismic expansion joint cover assembly according to claim 29 and further comprising low friction elements on the undersurface of the second floor cover plate to minimize friction between the second floor cover plate and the floor bridge panel upon movement of the second floor cover plate relative to the floor bridge panel in an earthquake.

51. A seismic expansion joint cover assembly according to claim 29 and further comprising a transverse beam supporting the second cover plate, extending between and slidably supported by the side members of the cover plate frame and located intermediate of the end member of the cover plate frame and the second end of the floor bridge panel, and control means for moving the transverse beam in the direction of the first axis upon and in a proportional relationship of one-half to movements of the second floor portion relative to the floor bridge panel.

52. A seismic expansion joint cover assembly according to claim 51 wherein the control means includes at least two slide members slidably received on the transverse beam in spaced apart relation, a first pair of control arms, each pivotally connected between the end member of the cover plate frame and one of the sliders, and a second pair of control arms, each pivotally connected between the second end of the floor bridge panel and one of the sliders.

53. A seismic expansion joint cover assembly according to claim 51 and further comprising a linear slide bearing interposed between each slider and the transverse beam.

54. A seismic expansion joint cover assembly according to claim 51 wherein the linear slide bearing interposed between each slider and the transverse beam is of a high density low friction polymeric material.

55. A seismic expansion joint cover assembly according to claim 51 wherein the transverse beam has an supporting a portion of the second floor cover plate, the upper surface being of a low friction material.

56. A seismic expansion joint cover assembly according to claim 51 wherein linear bearings of a high density low friction polymeric material are interposed between the transverse beam and the side members of the cover plate frame.

57. A seismic expansion joint cover assembly according to claim 51 and further comprising a beam support bearing affixed to the transverse beam and received by the second bearing receiver.

58. A seismic expansion joint cover assembly according to claim 29 wherein the first retainer and the first linear guide bearing receiver are substantially coextensive in the direction of the second axis with the floor bridge panel in positions of the floor bridge panel at maximum expected displacements of the first floor portion in the direction of the second axis relative to the floor bridge panel.

* * * * *